US012319473B2

(12) United States Patent
Torriglia et al.

(10) Patent No.: US 12,319,473 B2
(45) Date of Patent: Jun. 3, 2025

(54) RECYCLABLE BAG

(71) Applicant: AMCOR FLEXIBLES NORTH AMERICA, INC., Neenah, WI (US)

(72) Inventors: Marco Torriglia, Varazze (IT); Alberto Vara Alonso, Madrid (ES); Nicola Catozzi, Sandrigo (IT)

(73) Assignee: AMCOR FLEXIBLES NORTH AMERICA, INC., Neenah, WI (US)

( * ) Notice: Subject to any disclaimer, the term of this patent is extended or adjusted under 35 U.S.C. 154(b) by 0 days.

(21) Appl. No.: 18/276,973

(22) PCT Filed: Mar. 10, 2021

(86) PCT No.: PCT/US2021/021705
§ 371 (c)(1),
(2) Date: Aug. 11, 2023

(87) PCT Pub. No.: WO2022/191833
PCT Pub. Date: Sep. 15, 2022

(65) Prior Publication Data

US 2024/0116679 A1 Apr. 11, 2024

(51) Int. Cl.

| | |
|---|---|
| ***B65D 33/00*** | (2006.01) |
| ***B65D 30/08*** | (2006.01) |
| ***B65D 30/20*** | (2006.01) |
| ***B65D 33/25*** | (2006.01) |
| ***B65D 75/58*** | (2006.01) |

(52) U.S. Cl.
CPC ..... *B65D 31/10* (2013.01); *B65D 31/02* (2013.01); *B65D 33/2533* (2013.01); *B65D 75/5805* (2013.01)

(58) Field of Classification Search
CPC .... B65D 31/10; B65D 31/02; B65D 33/2533; B65D 75/5805
USPC ..... 383/120
See application file for complete search history.

(56) References Cited

U.S. PATENT DOCUMENTS 7,122,234 B2 * 10/2006 Olofsson ..... B32B 27/08 428/480
8,240,915 B2 * 8/2012 Sargin ..... B65D 33/22 383/117

(Continued)

FOREIGN PATENT DOCUMENTS

EP 1796902 A1 6/2007
EP 2186741 B1 2/2011

(Continued)

OTHER PUBLICATIONS

PCT International Search Report, International Application No. PCT/US2021/021705, issued Nov. 19, 2021, 2 pages.

(Continued)

*Primary Examiner* — Peter N Helvey

(57) ABSTRACT

A hermetically sealed single lip bag has a front panel (210), a back panel (220), a first side panel and second side panel formed from a recyclable high-barrier packaging film. The recyclable high-barrier packaging film has a machine-direction oriented, polyethylene-based exterior film (110) and a polyethylene-based interior film (120). The exterior film (110) has a transverse direction secant modulus and a machine direction secant modulus, each between 1,000 and 1,800 N/mm$^2$.

19 Claims, 6 Drawing Sheets

(56) References Cited

U.S. PATENT DOCUMENTS

| | | | | |
|---|---|---|---|---|
| 8,297,840 | B2 * | 10/2012 | Jansen | B65D 33/22 383/88 |
| 8,834,335 | B2 * | 9/2014 | Chen | B65D 33/002 493/201 |
| 9,469,423 | B2 * | 10/2016 | Thomas, Jr. | B65D 75/008 |
| 9,550,608 | B2 * | 1/2017 | O'Connor | B65D 31/02 |
| 10,011,411 | B2 * | 7/2018 | Eberhard | B65D 65/40 |
| 10,189,621 | B2 * | 1/2019 | Dayrit | B32B 27/08 |
| 10,202,229 | B2 * | 2/2019 | Huerta | B32B 3/266 |
| 10,524,491 | B2 * | 1/2020 | Eskamani | B05B 13/0636 |
| 2009/0285511 | A1 * | 11/2009 | Aithani | B32B 27/327 525/227 |
| 2011/0150368 | A1 * | 6/2011 | Ellsworth | B65D 31/16 383/200 |
| 2020/0189248 | A1 | 6/2020 | Koesters et al. | |
| 2020/0254737 | A1 | 8/2020 | Gillespie et al. | |

FOREIGN PATENT DOCUMENTS

| | | | |
|---|---|---|---|
| EP | 2857323 | A1 | 4/2015 |
| EP | 2987744 | A1 | 2/2016 |
| EP | 3023356 | B1 | 1/2018 |
| EP | 3256317 | B1 | 9/2019 |
| EP | 3720707 | B1 | 10/2024 |
| RU | 2175630 | A1 | 11/2001 |
| WO | 2006037603 | A1 | 4/2006 |
| WO | 2017003773 | A1 | 1/2017 |
| WO | 2018202479 | A1 | 11/2018 |

OTHER PUBLICATIONS

ExxonMobil, Full PE pouches recycles to creat new pouches, Product Brochure, E0919-124E49, 2019, 3 pages.

Kunststoff Information, Kunststoff Recycling, Available at URL: https://www.kiweb.de, Nov. 7, 2019, 1 page.

Test Resources, Measuring the Modulus of Elasticity When Testing Plastics, Available at: https://www.testresources.net/blog/how-to-choose-a-measurement-of-elasticity-for-plastics; Apr. 27, 2017, 1 page.

* cited by examiner

RECYCLABLE BAG

TECHNICAL FIELD

This disclosure is related to bags of the single-lip format and recyclable high-barrier film structures used to produce the bags. The hermetically sealed single-lip bags provide for product protection, easy opening functionality and superior durability.

BACKGROUND

Pre-made high barrier single-lip bags are made using highly engineered flexible structures. The flexible structures typically have a multitude of films, layers and materials to achieve the necessary characteristics for making, filling and distributing the bags. The bags often include many convenience features such as a flat bottom, an easy open system, and a reclose system. A variety of food or other consumer goods may be packaged in the single-lip bags.

The format of the bag allows the bag to stand upright easily, having large flat areas for product information and marketing graphics. The format of the bag allows for high filling volume of flowable product. However, the format of the bag also requires a demanding bag making process, due to the many triple-points in the seals where three or more bag panels meet. High temperatures are required to drive enough heat into the sealing layer to achieve good caulking in the triple-point. As a result, high temperature resistant polymers are typically used on the exterior surface of the flexible structure, such as oriented polyester or oriented polyamide, and low temperature softening polymers are typically used on the interior surface of the flexible structure, such as ethylene-copolymers. This mix of polymeric materials leads to a flexible structure and a bag that cannot be recycled in a single-polymer recycling stream.

SUMMARY

Disclosed herein are hermetically sealed single-lip bags constructed from a recyclable high-barrier packaging film. The packaging film is designed such that the unfilled bags can be produced on standard bag making equipment and the bags can be filled and sealed on standard filling equipment. When filled with dry product, the hermetically sealed bags have excellent drop strength, product protection and offer easy to open and close functionality.

The embodiments of the hermetically sealed single-lip bag have a front panel, a back panel, a first side panel, a second side panel, a bottom panel, a top seal, a first side seal, a second side seal and a bottom seal. The first side seal has a top portion bonding the front panel to the back panel, a front leg portion bonding the front panel to the first side panel, and a back leg portion bonding the back panel to the first side panel. Similarly, the second side seal has a top portion bonding the front panel to the back panel, a front leg portion bonding the front panel to the second side panel, and a back leg portion bonding the back panel to the second side panel. In some embodiments, the bottom seal bonds the front panel to the back panel. In other embodiments, the single lip bag further comprises a bottom panel and the bottom seal has a front portion bonding the front panel to the bottom panel, a back portion bonding the back panel to the bottom panel, a first side portion bonding the first side panel to the bottom panel, and a second side portion bonding the second side panel to the bottom panel.

In some embodiments of the single-lip bag, each of the front panel, the back panel, the first side panel, the second side panel and the bottom panel (if present) is constructed from a recyclable high-barrier packaging film comprising a machine-direction oriented polyethylene-based exterior film and a polyethylene-based interior film. The polyethylene-based exterior film may have a transverse direction secant modulus and a machine direction secant modulus, each between 1,000 and 1,800 $N/mm^2$. Ideally, the recyclable high barrier packaging film comprises an ethylene vinyl alcohol copolymer, not to exceed 5%, by weight of the overall composition.

The single-lip bag may include an adhesive layer connecting the exterior film to the interior film.

The recyclable high-barrier packaging film may further include a heat resistant over-print varnish located on the exposed surface of the exterior film.

In some embodiments of the single-lip bag, the interior film of the recyclable high-barrier packaging film may have a first outer layer comprising a sealing surface, a second outer layer and a first inner layer, wherein the first inner layer of the interior film comprises the ethylene vinyl alcohol copolymer. The interior film may further include a white pigment located in a second inner layer, wherein the second inner layer of the interior film is located between the first inner layer of the interior film and the exterior film. If the interior film contains a white pigment, the interior film preferably has a diffuse optical density between 0.30 and 0.50 units. The sealing surface of the interior film preferably has a dynamic COF above 0.35 as measured by ASTM 1894.

The hermetically sealed single-lip bag may be made of a recyclable high-barrier packaging film including an exterior film consisting of one or more polyethylene-based polymers. In some embodiments, the exterior film has a density between 0.93 g/cm3 and 0.95 g/cm3. In some embodiments, the exterior film has a transverse direction elongation at break greater than 500% as measured by ASTM D882. In some embodiments, the exterior film has a machine direction free shrink of less than 5% after heating an unrestrained sample in an oven at 100° C. for 15 minutes. In some embodiments, the exterior film has a machine direction free shrink of less than 3% after heating an unrestrained sample in an oven at 100° C. for 15 minutes.

The hermetically sealed single-lip bag may have a total composition comprising between 90% and 99% polyethylene-based polymer, by weight. Some embodiments of the hermetically sealed single lip bag further include a zipper closure, a line of weakness on the front panel extending between the top portion of the first side seal and the top portion of the second side seal, and/or a tear notch having a non-rounded interior shape, the tear notch adjacent to the line of weakening. The bag may have a second line of weakness on the back panel extending between the top portion of the first side seal and the top portion of the second side seal.

The hermetically sealed single lip bag may have a product inside the bag and the product may be a dry particulate product. The weight of the product may be between 300 g and 10 kg.

BRIEF DESCRIPTION OF THE DRAWINGS

The disclosure may be more completely understood in consideration of the following detailed description of various embodiments of the disclosure in connection with the accompanying drawings, in which.

Figure 1:
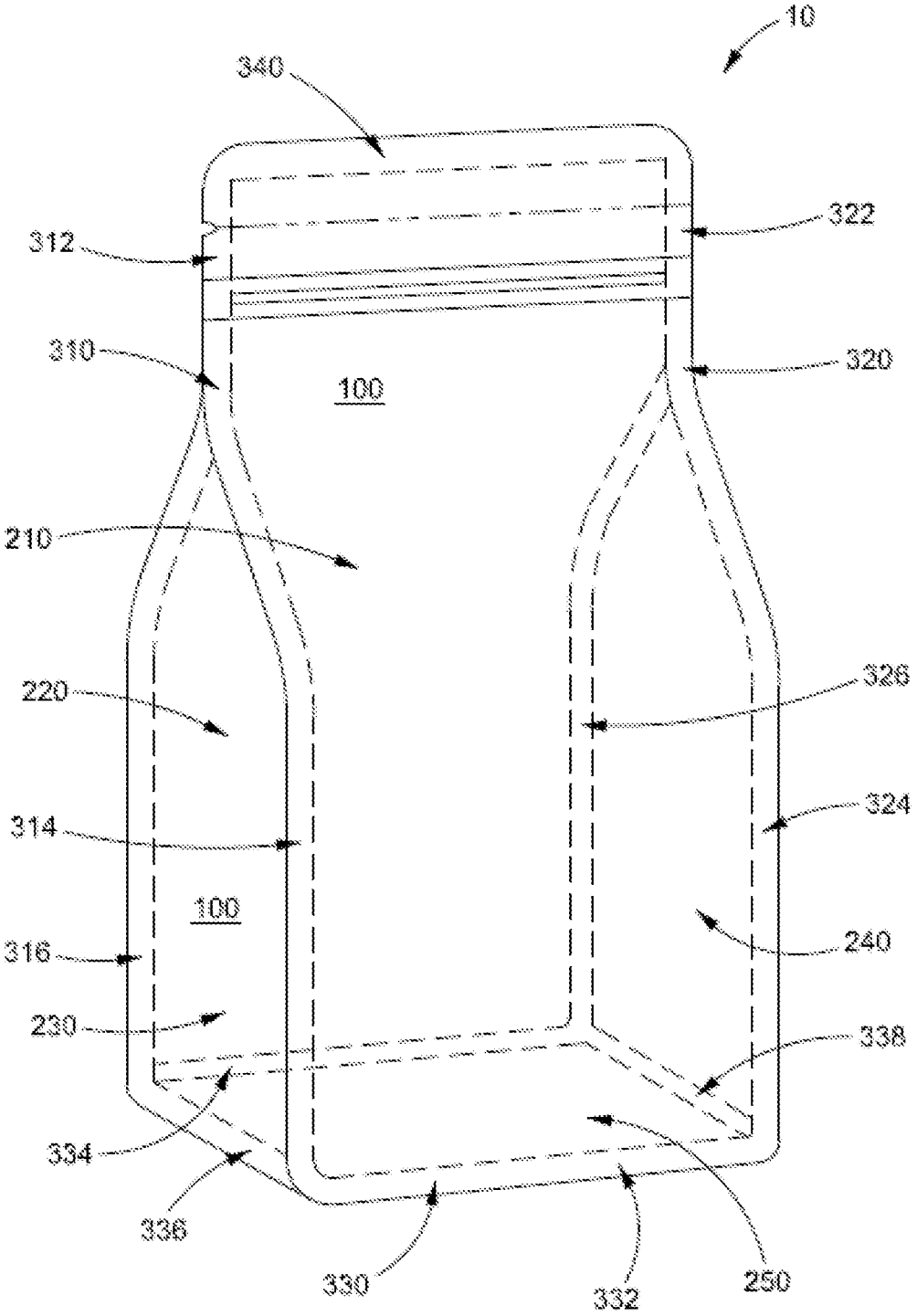
FIG. 1 is a schematic view of an embodiment of the hermetically sealed single-lip bag.

The drawings show some but not all embodiments. The elements depicted in the drawings are illustrative and not necessarily to scale, and the same (or similar) reference numbers denote the same (or similar) features throughout the drawings.

DETAILED DESCRIPTION

Introduction

Single-lip bags are used to package dry products which require significant protection from the environment. The single-lip bags are manufactured from high-barrier packaging films which can be hermetically sealed. Thus, once filled and sealed, environmental gasses and moisture are effectively prevented from entering the bag and negatively affecting the product packaged therein. In the past, the high-barrier packaging films contained several different polymeric material types (i.e. combinations of polyester, polyamide and polyolefin) to achieve the critical qualities of the hermetically sealed single-lip bag application. It is desirable to design a high-barrier packaging film with limited material types, moving as much of the structure as possible to a single polymer type. In this manner, the single-lip bag made from the high-barrier packaging film may be considered recyclable.

The focus of the single-lip bags described herein is to allow consumers to easily recycle the bag in a polyethylene or polyolefin recycling stream, while maintaining the high-performance characteristics including hermetic seals and excellent toughness and durability.

The single-lip bags described herein include high levels of polyethylene-based polymers, in excess of 90% or even 95%, by weight. The high-barrier packaging film used to produce the single lip bags include high levels of polyethylene-based polymers, in excess of 90% or even 95%, by weight. Any additional components of the single-lip bags, such as zippers, may also include high levels of polyethylene-based polymers.

There are many competing characteristics of a high-barrier packaging film intended to be used for hermetically sealed single-lip bags. First, the film must have good heat resistance such that the film does not become marred or otherwise damaged through the strenuous bag making process. Second, the film must provide for heat seals that can caulk triple-point seal areas yet remain strong after the seal is made. Third, the film must have good integrity to survive drops and other abuse after being filled and sealed. The details of these challenges will be further described below. It was unexpectedly and advantageously found that a high-barrier packaging film, produced from a high percentage of polyethylene-based polymers, designed according to the characteristics described here, was able to achieve a balance between each of these characteristics, and could be used to produce high performance hermetically sealed single-lip bags. This discovery renders the bags suitable for use in packaging sensitive products and recyclable, as desired.

Single Lip Bag

An embodiment of a single-lip bag 10, as described herein, may have construction features as shown in FIG. 1. The bag has a front panel 210, a back panel 220, a first side panel 230, a second side panel 240 and a bottom panel 250. Each of the panels is constructed from a recyclable high-barrier packaging film. The panels may be constructed of the same recyclable high-barrier packaging film (i.e. all panels identical), or the panels may be constructed of a different recyclable high-barrier packaging film (i.e. the panels are constructed from more than one recyclable high-barrier packaging film).

The panels of the single-lip bag 10 are connected by seals. As used herein, seals between the panels are heat seals produced by the application of heat and pressure, as is known in the art. The front panel 210 and the back panel 220 are connected at or near the top of the bag by a top seal 340. The front panel 210 and the back panel 220 are also connected by a top portion 312 of a first side seal 310 and a top portion 322 of a second side seal 320. The first side seal 310 and second side seal 320 extend from the top to the bottom of the bag 10. The first side seal 310 further includes a front leg portion 314 connecting the front panel 210 to the first side panel 230 and a back leg portion 316 connecting the back panel 220 to the first side panel 230. In this manner, the first side panel 230 has a gusset-like formation, terminating in a triple-point of the first side seal 310 where the first side panel 230, the front panel 210 and the back panel 220 meet. Likewise, the second side seal 320 further includes a front leg portion 324 connecting the front panel 210 to the second side panel 240 and a back leg portion 326 connecting the back panel 220 to the second side panel 240. The second side panel 230 has a gusset-like formation, terminating in a triple-point of the second side seal 320 where the second side panel 240, the front panel 210 and the back panel 220 meet. To complete the pouch, the bottom panel 250 is connected by a bottom seal 330. The bottom seal 330 has a front portion 332 connecting the front panel 210 to the bottom panel 250, a back portion 334 connecting the back panel 220 to the bottom panel 250, a first side portion 336 connecting the first side panel 230 to the bottom panel 250 and a second side portion 338 connecting the second side panel 240 to the bottom panel 250. Each portion of the bottom seal terminates at a triple point of the bottom seal (i.e. four triple points, one at each corner of the bottom panel), where three of the panels meet.

Figure 7:
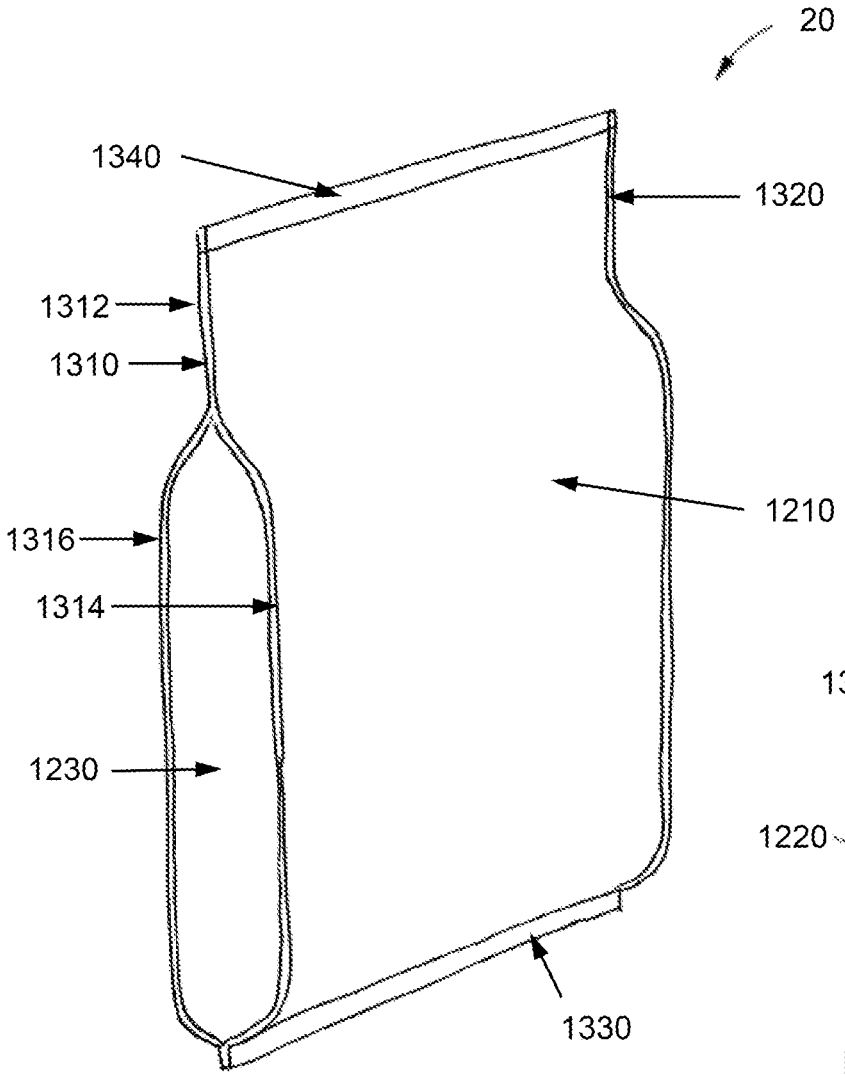
FIG. 7 is a schematic view of an embodiment of the hermetically sealed single-lip bag.
Figure 8:
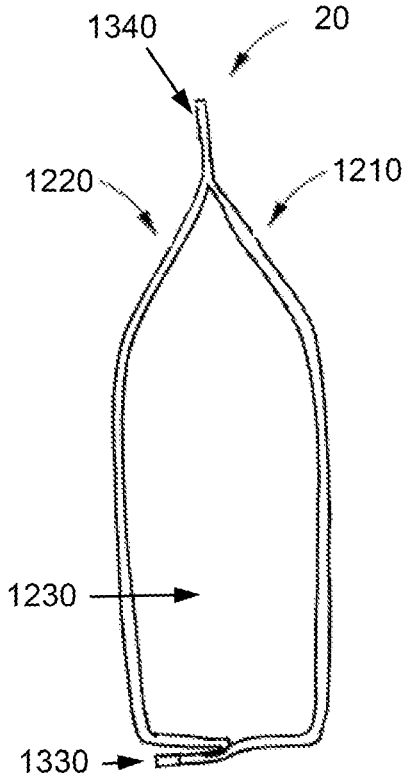
FIG. 8 is a side view of an embodiment of the hermetically sealed single-lip bag.

Another embodiment of a single lip bag 20, as described herein, may have construction features as shown in FIGS. 7 and 8. The bag has a front panel 1210, a back panel 1220, a first side panel 1230, and a second side panel (not shown). Each of the panels is constructed from a recyclable high-barrier packaging film. The panels may be constructed of the same recyclable high-barrier packaging film (i.e. all panels identical) or the panels may be constructed of a different recyclable high-barrier packaging film (i.e. the panels are constructed from more than one recyclable high-barrier packaging film).

The panels of the single-lip bag 20 are connected by seals. As used herein, seals between the panels are heat seals produced by the application of heat and pressure, as is known in the art. The front panel 1210 and the back panel 1220 are connected at or near the top of the bag by a top seal 1340. The front panel 1210 and the back panel 1220 are also connected by the top portion 1312 of a first side seal 1310 and a top portion (not shown) of a second side seal 1320. The first side seal 1310 and second side seal 1320 extend from the top to the bottom of the bag 20. The first side seal 1310 further includes a front leg portion 1314 connecting the front panel 1210 to the first side panel 1230 and a back leg portion 1316 connecting the back panel 1220 to the first side panel 1230. In this manner, the first side panel 1230 has a gusset-like formation, terminating in a triple-point of the first side seal 1310 where the first side panel 1230, the front panel 1210 and the back panel 1220 meet. Likewise, the second side seal 1320 further includes a front leg portion (not shown) connecting the front panel 1210 to the second side panel (not shown) and a back leg portion (not shown) connecting the back panel 1220 to the second side panel (not shown). The second side panel has a gusset-like formation, terminating in a triple-point of the second side seal 1320 where the second side panel, the front panel 1210 and the back panel 1220 meet. To complete the pouch, the front panel 1210 is connected to the back panel 1220 by a bottom seal 1330.

The single-lip bags as described herein can be used to package a variety of products, especially those that are sensitive to moisture, oxygen and/or other gases. The bags can be filled and hermetically sealed. A hermetically sealed single-lip bag as described herein does not have leaks in the seals, even at the triple point areas of the heat seals. In other words, the single-lip bags are airtight. The recyclable high-barrier packaging film has sufficient integrity and the heat seals are formed such that the packaged product is effectively isolated and protected from the environment external to the bag.

Figure 2:
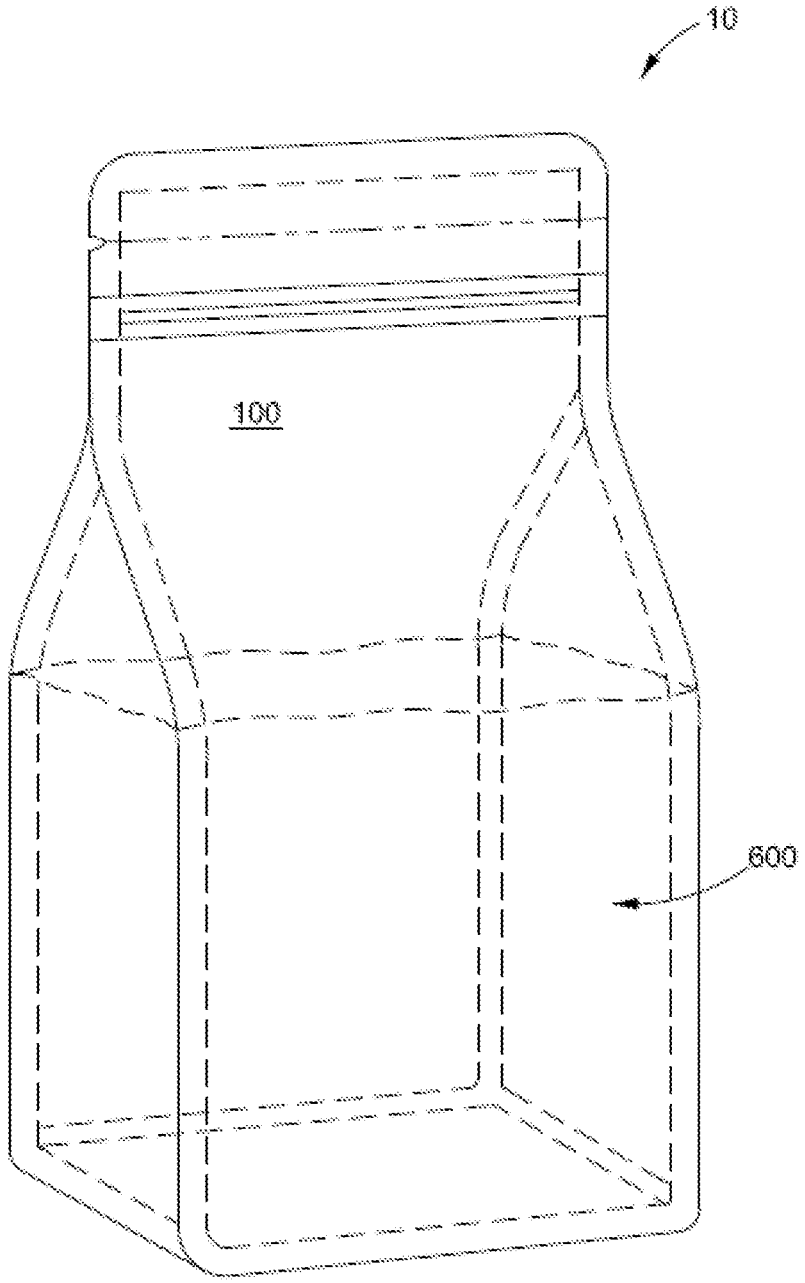
FIG. 2 is a schematic view of an embodiment of the hermetically sealed single-lip bag.

The single-lip bags described herein are useful for packaging a wide variety of products. As shown in FIG. 2, the hermetically sealed single-lip bag 10 constructed from panels of a recyclable high-barrier packaging film 100 (to be further described herein), contains a product 600 in an interior space. Products may be semi-moist or dry particulate product that may be sensitive to degradation by exposure to moisture and/or oxygen. Examples of products that may be packaged in the hermetically sealed single-lip bags include pet food kibble, dry milk powder, protein powder, dry drink mix, cocoa, rice or other grains. The bags may have a wide variety of dimensions (i.e. height, width, depth), but are generally capable of standing upright easily when filled with product and often have a height that is greater than the width. The bags may be of sufficient dimension that they can contain a product having a weight from about 300 grams to about 10 kilograms.

The single-lip bags are typically pre-made, meaning that they are produced on a piece of equipment dedicated to bag-making, in a separate process from filling and final sealing the pouch. Bag-making utilizes one or more rolls of recyclable high-barrier packaging film, mechanically forming and heat sealing the panels. During production of the pre-made bags, additional features may be added, such as zippers and tear notches.

The pre-made single-lip bags are filled and sealed on filling lines, as is known in the art. The bag is mechanically opened, a measured quantity of product is loaded into the interior space of the bag, and a final seal (top seal 340) is completed, hermetically sealing the product within the single-lip bag.

Figure 3A:
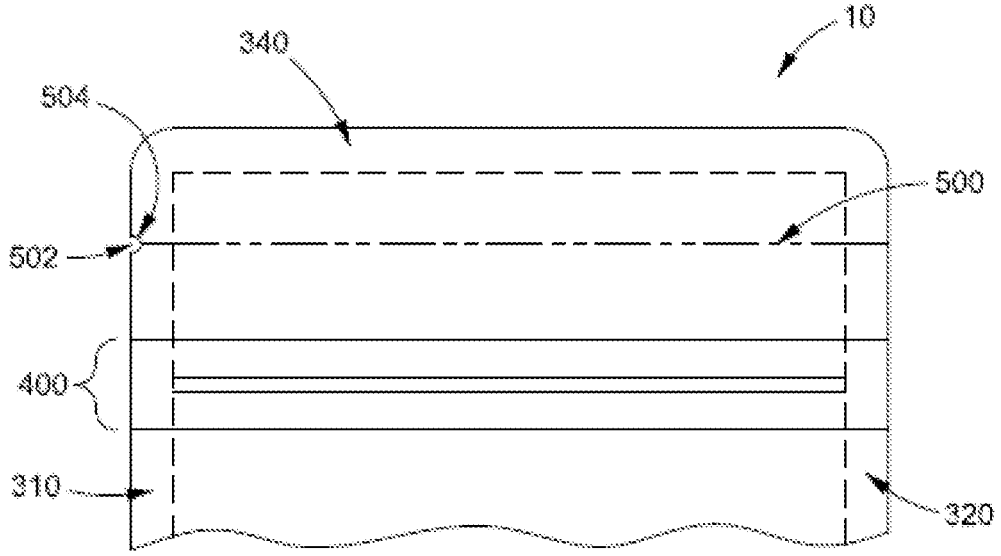
FIG. 3*a* is a schematic view of the top portion of an embodiment of the hermetically sealed single-lip bag.
Figure 3B:
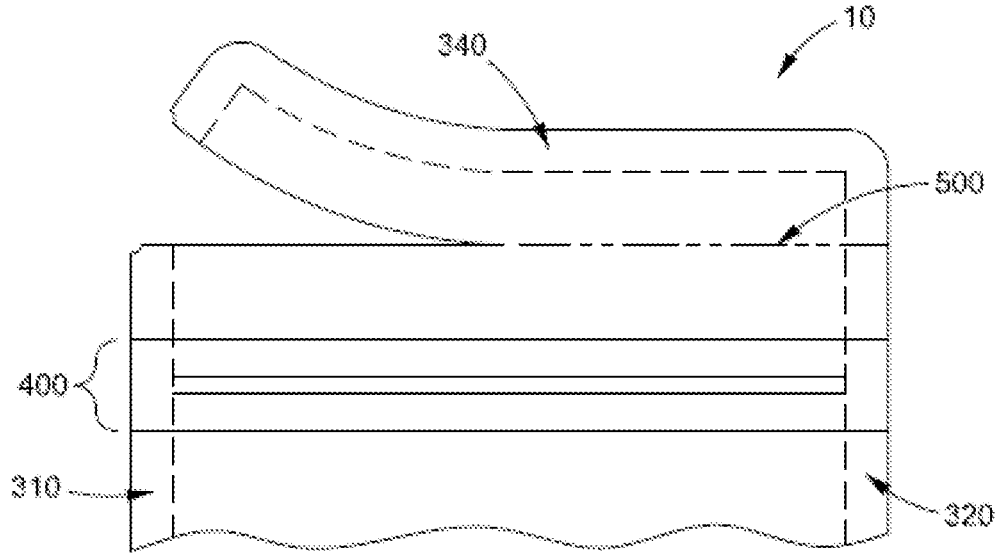
FIG. 3*b* is a schematic view of the top portion of an embodiment of the hermetically sealed single-lip bag, which has been partially opened.

The single-lip bag may be produced with additional features and/or components. These features and/or components, such as tear lines, tear notches and zippers, may facilitate easy opening of the bag and reclosing of the bag after the initial opening as shown in FIGS. 3*a* and 3*b*. FIGS. 3*a* and 3*b* are schematic views of the top portion of an embodiment of the hermetically sealed single-lip bag 10. As shown, a zipper 400 may be included, spanning from the first side seal 310 to the second side seal 320. Upon bag making, the zipper is included within each of the side seals and is typically attached to both the front and back panels across the entire width of the bag. The zipper 400 can be manually opened and pressed to reseal, as is common in may package styles. Selection of the zipper component should be done such that the composition of the zipper is either 100% or nearly 100% polyethylene-based polymer, such that it does not detract from the recyclability of the bag. The selection of the zipper should also take into account that it is necessary to create a hermetic seal around the zipper.

The embodiments shown in FIGS. 3*a* and 3*b* also depict a line of weakness 500 and a tear notch 502. In various embodiments, lines of weakness and tear notches may be used together or independently. The line of weakness 500 and/or tear notch 502 are present to allow for manual opening of the bag, without the use of a tool, such as a scissors. As shown in FIG. 3*b*, the top seal 340 of the bag can be torn away from the remainder of the bag at the point of the tear notch 502 or line of weakness 500, breaking the hermiticity of the bag and allowing for access to the contents of the bag.

A line of weakness 500 may be present in either or both of the front panel and the back panel of the single-lip bag. In some embodiments, the line of weakness is formed mechanically. In other embodiments, the line of weakness is formed by laser scoring (i.e. a laser scored line of weakness). A line of weakness may be either continuous, spanning from one side edge of the pouch to the other side edge of the pouch, or it may be intermittent. In some embodiments, there are multiple lines of weakness in a single panel, running parallel to each other.

A particularly advantageous embodiment of a single-lip bag includes a laser scored line of weakness in the front panel and a laser scored line of weakness in the back panel. Each of the laser scored lines of weakness span across the front or back panel from the first side seal 310 to the second side seal 320. The laser scoring operation used to produce the scored lines of weakness may be applied from the sealing surface side of the panel (as will be described later). This orientation of application of the line of weakness has a significant influence on the tear performance. The line of weakness is more effective, producing an easier tear. This will be further discussed in relation to the structure of the recyclable high-barrier packaging film.

Figure 4A:
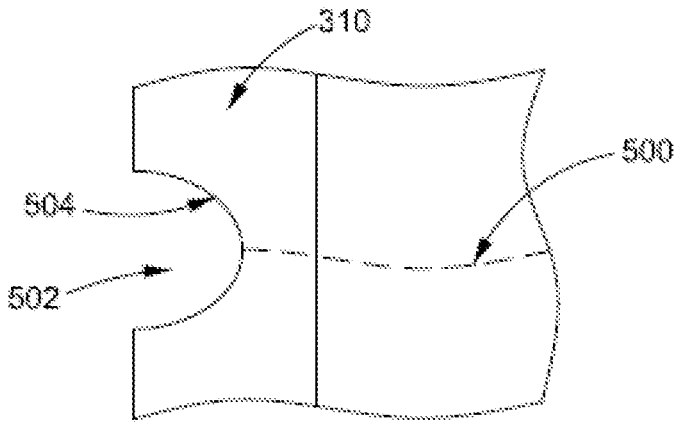
FIG. 4*a* is a schematic view of the tear notch detail on an embodiment of the hermetically sealed single-lip bag.
Figure 4B:
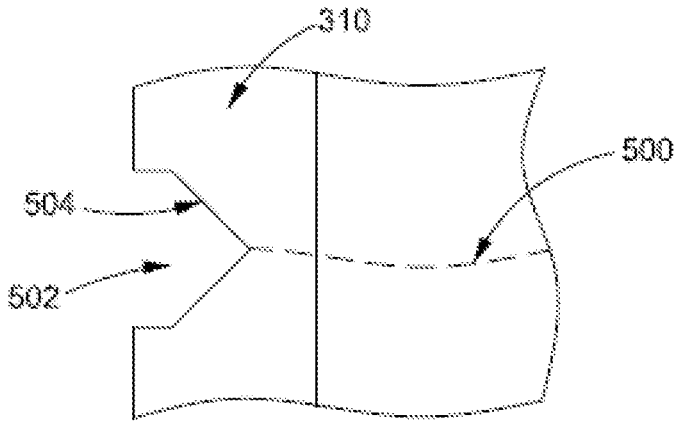
FIG. 4*b* is a schematic view of the tear notch detail on an embodiment of the hermetically sealed single-lip bag.

A tear notch 502 may be present in either or both the first side seal 310 and the second side seal 320. The tear notch 502 should be adjacent to the line of weakness 500, if both are present. In some embodiments, the internal shape of the tear notch 504 is rounded, an example of which is shown in FIG. 4*a*. In some embodiments, the internal shape of the tear notch 504 is non-rounded, an example of which is shown in FIG. 4*b*.

As described herein, the "total composition" of the single-lip bag refers to all components, including the panels, zipper and any other additional components. The total composition may include between 90% and 99% polyethylene-based materials, by weight. In some embodiments, the total composition of the single-lip bag is greater than 90%, or greater than 95% polyethylene-based materials, by weight.

As used herein, the term "polyethylene-based polymer" refers to a polymer that possesses ethylene linkages and maintain a glass transition temperature below 50° C. The polymer may be a homopolymer of ethylene or a copolymer of ethylene and other monomers. Examples of polyethylene-based polymers include but are not limited to low-density polyethylene (LDPE), high-density polyethylene (HDPE), linear low-density polyethylene (LLPDE), metallocene-catalyzed linear-low density polyethylene (mLLDPE), ethylene-vinyl acetate copolymer (EVA), cyclic olefin copolymers (COC), and maleic anhydride grafted polyethylene (MAH-PE). As used herein, "polyethylene-based" does not encompass ethylene vinyl alcohol copolymers (EVOH), as this material is accounted for separately.

As used herein, the term "polyethylene-based" refers to an article (i.e. a bag, a film, a layer, etc.) that comprises high levels of polyethylene-based polymers. In some cases, a polyethylene-based article has at least 50% polyethylene-based polymers, by weight. Or, a polyethylene-based article may have at least 60%, at least 70%, at least 80%, at least 90% or at least 95% polyethylene-based polymers, by weight. In some cases, a polyethylene-based article consists of polyethylene-based polymers.

The recyclable high-barrier packaging film used for the panels of the single-lip bag contains ethylene vinyl alcohol copolymer to increase gas barrier properties, as will be discussed later. The ethylene vinyl alcohol copolymer is not considered to be a polyethylene-based polymer as described herein, as it can cause issues in a polyethylene or polyolefin recycling stream. The total composition of the single-lip bag contains less than 5%, less than 4%, or less than 3% ethylene vinyl alcohol copolymer, by weight. Some embodiments of the single-lip bag have a total composition including between 1')/0 and 5% ethylene vinyl alcohol copolymer, by weight.

The hermetically sealed single-lip bags described herein have the distinct and surprising advantage of recyclability in a polyethylene or polyolefin recycling stream. This advantage is achieved while maintaining a suitably hermetic package, having excellent durability, excellent drop strength and easy opening.

Recyclable High-Barrier Packaging Film

The single-lip bags described herein have panels formed from a recyclable high-barrier packaging film. As used herein, the term "recyclable" is intended to reflect that the material can be easily processed in a recycling process that accepts "all-polyethylene" articles or "all-polyolefin" articles. Typically, these recycling processes can accept low levels of some contaminant material. As such, as used herein, recyclable refers to the packaging film having very high levels of polyethylene and low levels of acceptable contaminates. The total composition defined by weight of materials defines the recyclability of the packaging film. As described herein, the "total composition" of the recyclable high-barrier packaging film refers to all materials encompassed therein. The total composition of the packaging film may include between 90% and 99% polyethylene-based materials, by weight. In some embodiments, the total composition of the recyclable high-barrier packaging film is greater than 90%, or greater than 95% polyethylene-based materials, by weight.

The recyclable high-barrier packaging film may have an oxygen transmission rate of less than 1.0 $cm^3/m^2$ day bar, or between 0.1 $cm^3/m^2$ day bar and 1.5 $cm^3/m^2$ day bar, or between 0.5 $cm^3/m^2$ day bar and 1.0 $cm^3/m^2$ day bar, when measured at 23° C. and 50% relative humidity using ASTM F1927. The recyclable high-barrier packaging film may have an oxygen transmission rate of less than 2.0 $cm^3/m^2$ day bar, or between 0.5 $cm^3/m^2$ day bar and 5.0 $cm^3/m^2$ day bar, or between 1.0 $cm^3/m^2$ day bar and 2.0 $cm^3/m^2$ day bar, when measured at 23° C. and 70% relative humidity using ASTM F1927. The recyclable high-barrier packaging film may have a moisture transmission rate of less than 1.0 $g/m^2$ day, or between 0.1 $g/m^2$ day and 1.0 $g/m^2$ day, or between 0.3 $g/m^2$ day and 1.0 $g/m^2$ day when measured at 23° C. using ASTM F1249. The recyclable high-barrier packaging film may have a moisture transmission rate of less than 5.0 $g/m^2$ day, or between 1.0 $g/m^2$ day and 5.0 $g/m^2$ day, or between 1.5 $g/m^2$ day and 4.0 $g/m^2$ day when measured at 38° C. using ASTM F1249.

As mentioned previously, the recyclable high-barrier packaging film contains ethylene vinyl alcohol copolymer, commonly referred to as EVOH, to decrease the transmission of gases. EVOH is otherwise known as saponified or hydrolyzed ethylene vinyl acetate copolymer and refers to a vinyl alcohol copolymer having an ethylene comonomer. EVOH is prepared by the hydrolysis (or saponification) of an ethylene vinyl acetate copolymer. The degree of hydrolysis is preferably from about 50 to 100 mole percent, more preferably from about 85 to 100 mole percent, and most preferably at least 97%. It is well known that to be a highly effective oxygen barrier, the hydrolysis-saponification must be nearly complete, i.e., to the extent of at least 97%. EVOH is commercially available in resin form with various percentages of ethylene. It is expected that processability would be facilitated at higher ethylene contents; however, gas permeabilities, particularly with respect to oxygen, may become undesirably high for certain packaging applications which are sensitive to microbial growth in the presence of oxygen. Conversely, lower ethylene content may have lower gas permeabilities, but processability may be more difficult. In some embodiments, the ethylene vinyl alcohol copolymer present in the recyclable high-barrier packaging film comprises from about 27-48 mole % ethylene. EVOH may be further optimized by blending, special copolymerization or crosslinking to be more heat resistant or enhance other properties. The total composition of the recyclable high-barrier film may include between 0.5% and 5% ethylene vinyl alcohol copolymer, by weight. In some embodiments, the total composition of the recyclable high-barrier film is less than 5%, or less than 4% ethylene vinyl alcohol copolymer, by weight.

As used herein, a "layer" is a homogeneous building block of films. Layers may be continuous or discontinuous (i.e. patterned) with the length and width of the film. As used herein, the term "film" is a mono-layer or multi-layer web that has an insignificant z-direction dimension (thickness) as compared to the x- and y-direction dimensions (length and width), not unlike a piece of paper. Films are generally regarded as having two major surfaces, opposite each other, expanding in the length and width directions. Films may be built from an unlimited number of films and/or layers, the films and/or layers being bonded together to form a composite article, such as a panel.

As used herein, the term "exterior" is used to describe a film, layer or surface that is located in a position such that it is at or near the surrounding environment when the film is used in a packaging application. As used herein, the term "interior" is used to describe a film, layer or surface that is located in a position such that it is at or near the packaged product when the film is used in a packaging application. As used herein, the term "inner" is used to describe a film or layer that is not located on the surface of the film in which it is comprised. An inner layer of a film is adjacent to another layer of the same film on both sides. In other words, the layers of a film that are at the surface of that film are not inner layers.

Figure 5:
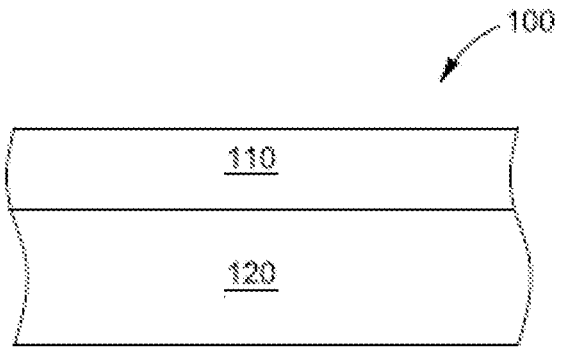
FIG. 5 is a cross-sectional view of an embodiment of the recyclable high-barrier packaging film.

An embodiment of the recyclable high-barrier packaging film is shown in FIG. 5. Here, the recyclable high-barrier packaging film 100 has a machine-direction oriented polyethylene-based exterior film 110. When used to form a hermetically sealed single-lip bag, the exterior film 110 is located so that it is in contact with the environment surrounding the package. The recyclable high-barrier packaging film 100 has a polyethylene-based interior film 120. When used to form a hermetically sealed single-lip bag, the interior film 120 is located so that it is in contact with the interior space of the package and/or the product within the package. The exterior film 110 and the interior film 120 are connected to each other by any means known to those skilled in the art of packaging film converting.

Figure 6:
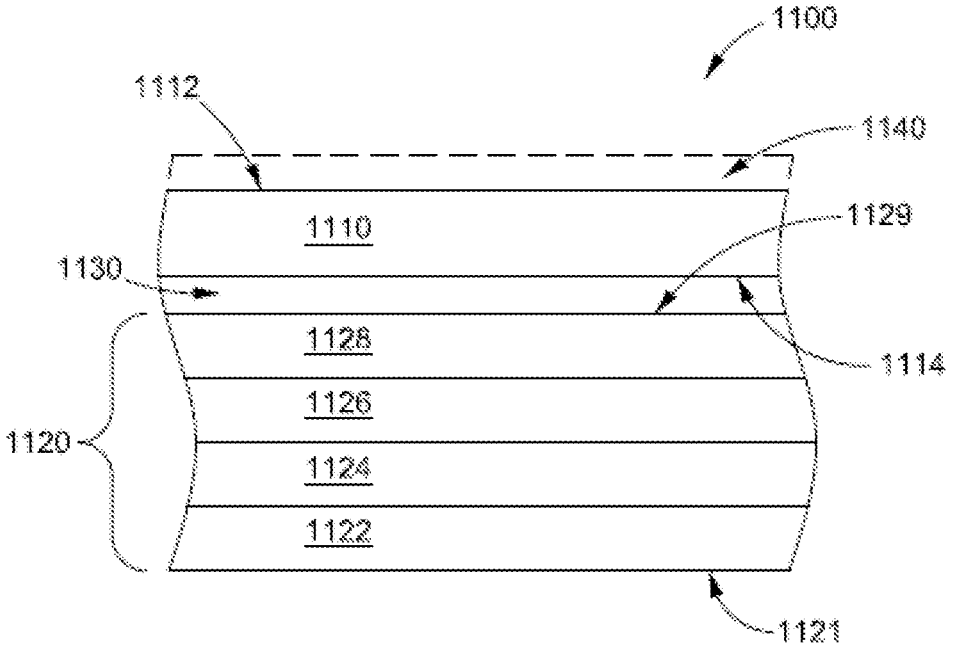
FIG. 6 is a cross-sectional view of an embodiment of the recyclable high-barrier packaging film.

Another embodiment of the recyclable high-barrier packaging film is shown in FIG. 6. Here, the packaging film 1100 has an exterior film 1110 and an interior film 1120, connected to each other by an adhesive layer 1130. The exterior film has an exposed surface 1112 and a laminating surface 1114. The interior film has a first outer layer 1122 having a sealing surface 1121, a second outer layer 1128 having a laminating surface 1129. The interior film has a first inner layer 1124 and a second inner layer 1126. The first inner layer 1124 contains ethylene vinyl alcohol copolymer and the second inner layer 1126 contains a white pigment. The second inner layer 1126 is in a relatively exterior position when compared to the first inner layer 1124. In other words, the second inner layer 1126 is between the first inner layer 1124 of the interior film 1120 and the exterior film 1110. The recyclable high-barrier packaging film 1100 also has a heat resistant overprint varnish 1140 located on the exposed surface 1112 of the exterior film 1110.

As used herein, the terms "machine-direction oriented" and "MOD", indicate that the film has been heated to a temperature lower than the melting point of the material and stretched at least 2× in the machine-direction. This is typically accomplished by an MDO process using heated rolls. A typical blown film process does impart some stretching of the film, but not enough to be considered oriented as described herein. An oriented film may also be heat set (i.e. annealed) after orientation, such that it is dimensionally stable under elevated temperature conditions that might be experienced during conversion of the film (i.e. printing or laminating) or during the use of the packaging film (i.e. heat sealing). A film may be produced using specific polymers and may be oriented using specific conditions which optimize the heat resistance of the film.

The exterior film of the recyclable high-barrier packaging film is polyethylene-based. The exterior film may consist of one or more polyethylene-based polymers. The exterior film may consist of very high levels of polyethylene-based polymers, containing only small amounts of processing additives that are not polyethylene-based (i.e. antiblock, slip, etc.). The total composition of the exterior film may include between 90% and 99% polyethylene-based materials, by weight. In some embodiments, the total composition of the exterior film is greater than 90%, or greater than 95% polyethylene-based materials, by weight.

The exterior film may be mono-layer or multi-layer and may be produced by any known film converting method.

The exterior film of the recyclable high-barrier packaging film is machine direction oriented. Even though the exterior film is oriented, it is beneficial for the film to have a machine-direction free shrink of less than 5%, or preferably less than 3%, after heating and unrestrained sample of the film in an oven at 100° C. for 15 minutes. Higher shrink materials have a detrimental effect when used in pouch making as the shrinking film in the heat seal areas creates stress in the area adjacent to any unsealed areas (the body of the panels). When the exterior film of the recyclable high-barrier packaging film has low shrink under heating conditions, there is significantly less stress built up in the transition areas between the seals and the unsealed areas of the panels. Less stress in these areas leads to less failures during drop testing and other abusive handling.

The exterior film of the recyclable high-barrier packaging film may have a thickness from 10 microns to 100 microns, preferably from 20 microns to 50 microns. The exterior film may have a density from 0.92 g/cm$^3$ to 0.98 g/cm$^3$, preferably from 0.93 g/cm$^3$ to 0.95 g/cm$^3$.

The exterior film may have a transverse direction elongation at break greater than 500% when tested according to ASTM D882. Having an elongation at break at this level leads to a tougher overall pouch, able to survive severe impact, such as drop testing.

Optionally, the exposed surface of the exterior film is covered by a heat-resistant over-print varnish or lacquer. The over-print varnish may cover the entire exposed surface of the exterior film or it may be patterned. Preferably, this layer of varnish is clear and very thin, adding almost no additional stiffness to the overall structure. Additionally, the exterior film may be printed on either one or both surfaces, providing graphics to the overall film and bag.

The interior film of the recyclable high-barrier packaging film is polyethylene-based. The interior film is multi-layer may contain of one or more polyethylene-based polymers. The total composition of the interior film may include between 90% and 99% polyethylene-based materials, by weight. In some embodiments, the total composition of the interior film is greater than 90%, or greater than 95% polyethylene-based materials, by weight. The total composition of the interior film may include between 0.5% and 5% ethylene vinyl alcohol copolymer, by weight. In some embodiments, the total composition of the interior film is less than 5%, or less than 4% ethylene vinyl alcohol copolymer, by weight.

As discussed, the interior film may have a first outer layer which creates the sealing surface. This layer is arranged closest to the inside of the package when the recyclable high-barrier packaging film is formed into a single-lip bag. The first outer layer contains polyethylene-based polymers that can achieve low heat seal initiation temperatures for easy sealing and caulking of the bag triple points. Additionally, the sealing surface of the interior film should have a dynamic COF above 0.35 as measured by ASTM 1894.

As discussed, the interior film may have a first inner layer containing ethylene vinyl alcohol copolymer.

As discussed, the interior film may have a second inner layer containing a white pigment. The white concentrate gives the bag a nice appearance and opacity level. The white concentrate may give the interior film a diffuse optical density between 0.30 and 0.50 units when measured using a transmission densitometer.

As discussed, the interior film may have a second outer layer which creates the laminating surface.

The interior film may contain additional layers. The interior film should have a thickness from 25 micron to 200 micron, preferably from 50 micron to 150 micron.

Example

A recyclable high-barrier film was produced by laminating a 25 micron (0.94 g/cm$^3$ density) machine-direction oriented polyethylene-based film (exterior film) to a 120 micron polyethylene-based blown film (interior film), using a medium performance polyurethane-based adhesive. The exterior film had a machine direction secant modulus of about 1,600 N/mm$^2$, a transverse direction secant modulus of about 1,100 N/mm$^2$, and a transverse direction elongation at break of about 600% measured by ASTM D 882. The exterior film had a free shrink of approximately 2.5% in the machine direction when stored unrestrained in an oven at 100° C. for 15 minutes. The polyethylene-based interior film had a structure of lamination layer (i.e. second outer layer)/white pigment layer (i.e. second inner layer)/tie/EVOH containing layer (i.e. first inner layer)/tie/sealing layer (i.e. first outer layer), and a diffuse optical density of 0.41. The EVOH containing layer was approximately 5 micron in thickness. The COF of the sealing surface of the interior film was 0.46 (sealing surface to sealing surface, static) and 0.38 (sealing surface to sealing surface, dynamic) as measured by ASTM 1894.

The recyclable high-barrier packaging film was formed into a single lip bag having a front panel, a back panel, a first side panel, a second side panel and a bottom panel, as described herein. The bag also had a zipper inserted across the top portion as well as a laser scored line of weakness and a triangular shaped tear notch. The bag was filled with 4 kilograms resin granules and sealed closed, forming an airtight bag, without any leaks at any of the triple points or zipper areas. The bag was dropped from a height of 1 meter, three times consecutively, and no bag failures (bag tear or seal leak) were encountered. The bag was easily torn open across the line of weakness.

What is claimed is:

1. A hermetically sealed single-lip bag comprising:

a front panel, a back panel, a first side panel, a second side panel, a top seal, a first side seal, a second side seal and a bottom seal, wherein the first side seal comprises a top portion bonding the front panel to the back panel, a front leg portion bonding the front panel to the first side panel, and a back leg portion bonding the back panel to the first side panel, and the second side seal comprises a top portion bonding the front panel to the back panel, a front leg portion bonding the front panel to the second side panel, and a back leg portion bonding the back panel to the second side panel, and wherein each of the front panel, the back panel, the first side panel, and the second side panel is constructed from a recyclable high-barrier packaging film comprising a machine-direction oriented polyethylene-based exterior film and a polyethylene-based interior film, wherein the polyethylene-based exterior film has a transverse direction secant modulus and a machine direction secant modulus, each between 1,000 and 1,800 N/mm$^2$, and wherein the recyclable high barrier packaging film comprises an ethylene vinyl alcohol copolymer, not to exceed 5%, by weight.

2. The hermetically sealed single-lip bag of claim 1 further comprising a bottom panel constructed of a recyclable high-barrier packaging film, wherein the bottom seal comprises a front portion bonding the front panel to the bottom panel, a back portion bonding the back panel to the bottom panel, a first side portion bonding the first side panel to the bottom panel, and a second side portion bonding the second side panel to the bottom panel.

3. The hermetically sealed single-lip bag of claim 1 wherein the bottom seal bonds the front panel to the back panel.

4. The hermetically sealed single-lip bag of claim 1, further comprising an adhesive layer connecting the exterior film to the interior film.

5. The hermetically sealed single-lip bag of claim 1, wherein the recyclable high-barrier packaging film further comprises a heat resistant over-print varnish located on the exposed surface of the exterior film.

6. The hermetically sealed single-lip bag of claim 1, wherein the interior film comprises a first outer layer comprising a sealing surface, a second outer layer and a first inner layer, and wherein the first inner layer of the interior film comprises the ethylene vinyl alcohol copolymer.

7. The hermetically sealed single-lip bag of claim 6 wherein the interior film further comprises a white pigment located in a second inner layer, wherein the second inner layer of the interior film is located between the first inner layer of the interior film and the exterior film, and wherein the interior film has a diffuse optical density between 0.30 and 0.50 units.

8. The hermetically sealed single-lip bag of claim 1, wherein the sealing surface of the interior film has a dynamic COF above 0.35 as measured by ASTM 1894.

9. The hermetically sealed single-lip bag of claim 1, wherein the exterior film consists of one or more polyethylene-based polymers.

10. The hermetically sealed single-lip bag of claim 1, wherein the exterior film has a density between 0.93 g/cm$^3$ and 0.95 g/cm$^3$.

11. The hermetically sealed single-lip bag of claim 1, wherein the exterior film has a transverse direction elongation at break greater than 500% as measured by ASTM D882.

12. The hermetically sealed single-lip bag of claim 1, wherein the exterior film has a machine direction free shrink of less than 5% after heating an unrestrained sample in an oven at 100° C. for 15 minutes.

13. The hermetically sealed single-lip bag of claim 1, wherein the exterior film has a machine direction free shrink of less than 3% after heating an unrestrained sample in an oven at 100° C. for 15 minutes.

14. The hermetically sealed single-lip bag of claim 1, further comprising a total composition comprising between 90% and 99% polyethylene-based polymer, by weight.

15. The hermetically sealed single lip bag of claim 1, further comprising a zipper closure.

16. The hermetically sealed single lip bag of claim 1, further comprising a line of weakness on the front panel extending between the top portion of the first side seal and the top portion of the second side seal, and tear notch having a non-rounded interior shape, the tear notch adjacent to the line of weakening.

17. The hermetically sealed single-lip bag of claim 16 further comprising a second line of weakness on the back panel extending between the top portion of the first side seal and the top portion of the second side seal.

18. The hermetically sealed single lip bag of claim 1, further comprising a product inside the bag and the product is a dry particulate product.

19. The hermetically sealed single-lip bag of claim 18, wherein the product has a total weight between 300 g and 10 kg.

* * * * *